US006024102A

United States Patent [19]

Huang

[11] Patent Number: 6,024,102

[45] Date of Patent: Feb. 15, 2000

[54] BARRETTE

[76] Inventor: Chao-Hsiung Huang, P.O. Box 90, Tainan City, Taiwan

[21] Appl. No.: 09/307,424

[22] Filed: May 10, 1999

[51] Int. Cl.[7] ..... A45D 8/14

[52] U.S. Cl. ..... 132/273; 2/DIG. 11

[58] Field of Search ..... 132/273, 275; 2/DIG. 11, 174; D28/39, 41

[56] References Cited

U.S. PATENT DOCUMENTS

D. 342,154 12/1993 Capello ..... D28/41

2,660,826 12/1953 Bennett ..... 132/275

5,528,774 6/1996 Sanders ..... 2/DIG. 11

5,826,597 10/1998 Chou ..... 132/273

*Primary Examiner*—Todd E. Manahan

[57] ABSTRACT

A barrette has at least two elongate curved identical bodies, two position members provided with the same number of holes for the two ends of each elongate curved bodies to fit tightly therein to combine together the two elongate curved bodies for wearing on the hair of a user. A plurality of trinkets are fixed or hooked spaced apart changeably on the two elongate curved identical bodies for decoration and friction against the hair of the user, thereby increasing stability of the barrette on the hair.

4 Claims, 4 Drawing Sheets

BARRETTE

BACKGROUND OF THE INVENTION

This invention relates to a barrette, particularly to one having two elongate identical bodies combined together and resiliently clamping the hair of a user with constricting force, and a plurality of trinkets provided on the two elongate identical bodies to give decoration and produce friction against hair so as to keep the barrette stabilized on the hair, not slide off or permitting the hair to dishevel.

A conventional barrette shown in FIG. 1, has only an elongate curved body 10 provided with a smooth inner surface and a plurality of projections 11 protruding up from the smooth inner surface for increasing friction against the hair and not let the barrette slide off easily. Nevertheless, the conventional barrette generally has a single color or printed with various patterns on an outer surface to diversify its colors, and is devoid of a 3D appearance. So consumers may have to wear many different barrettes to wear show diversity.

SUMMARY OF THE INVENTION

This invention has been devised to offer a barrette with changeable trinkets and which does not slide off the hair and keep the hair neat.

The feature of the invention is two elongate identical curved bodies combined together with two position members each provided with at least the holes for two ends of the elongate bodies to fit therein.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
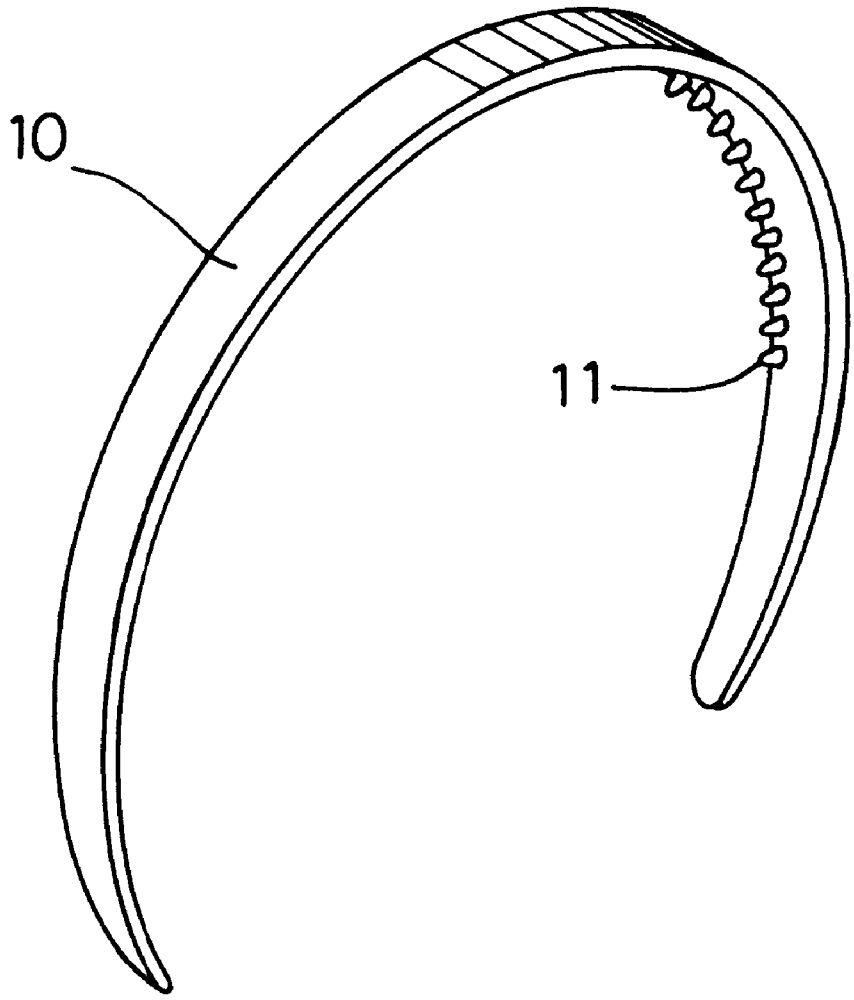
FIG. 1 (PRIOR ART)
FIG. 1 is a perspective view of a known conventional barrette.
Figure 2:
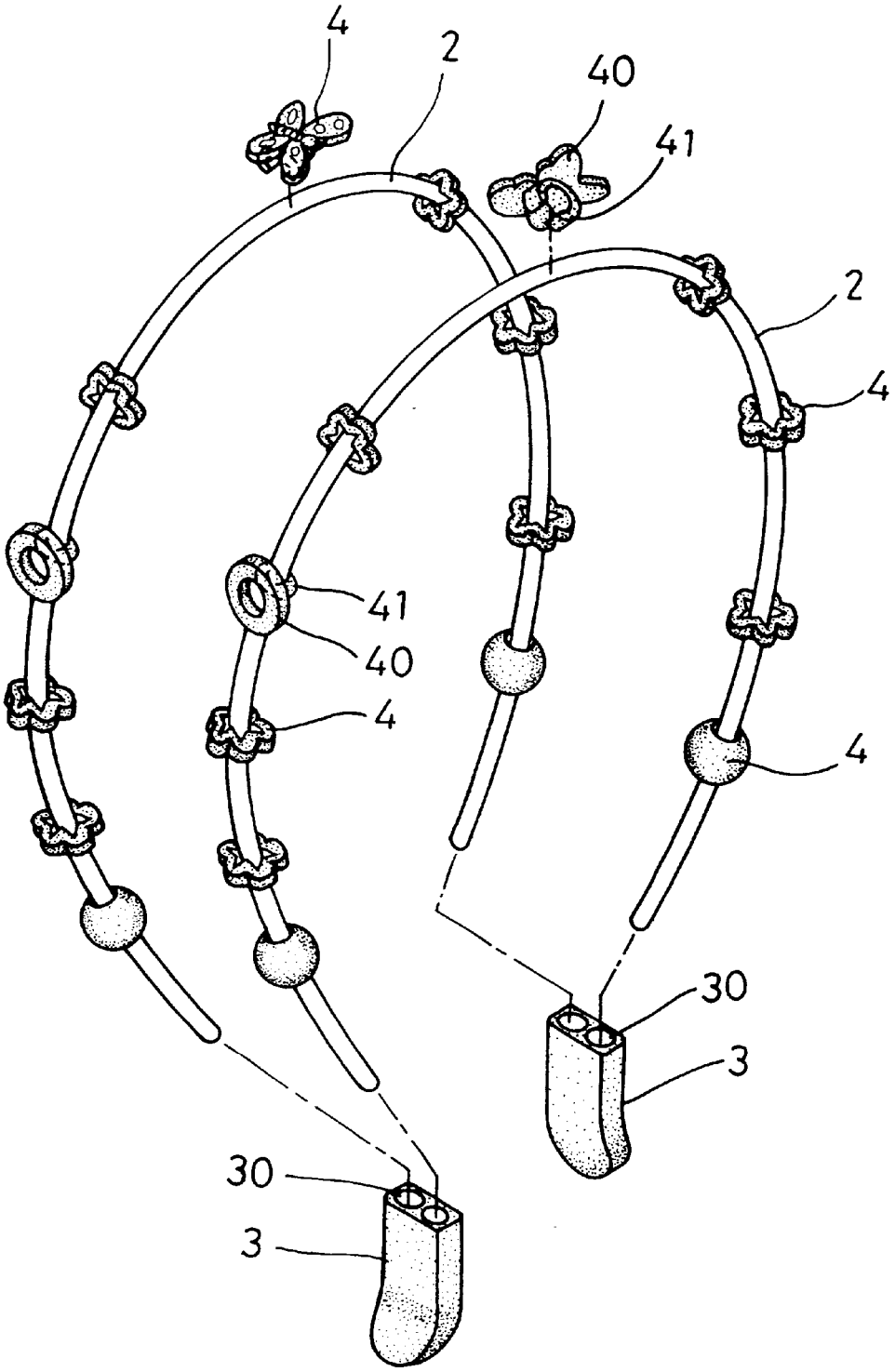
FIG. 2 is an exploded perspective view of a barrette in the present invention.

A preferred embodiment of a barrette in the present invention, as shown in FIG. 2, includes two elongate resilient curved identical bodies 2, two position members 3 for two ends of the elongate curved identical bodies 2 to fit tightly therein, a plurality of spaced trinkets 4 fixed or hooked on each elongate curved body 2 and having different shapes from one another. Each trinket 4 has a decorative member 40 and a fixing ring 41 being a ring or a C-shaped ring to be fixed around the elongate curved bodies 2.

Figure 3:
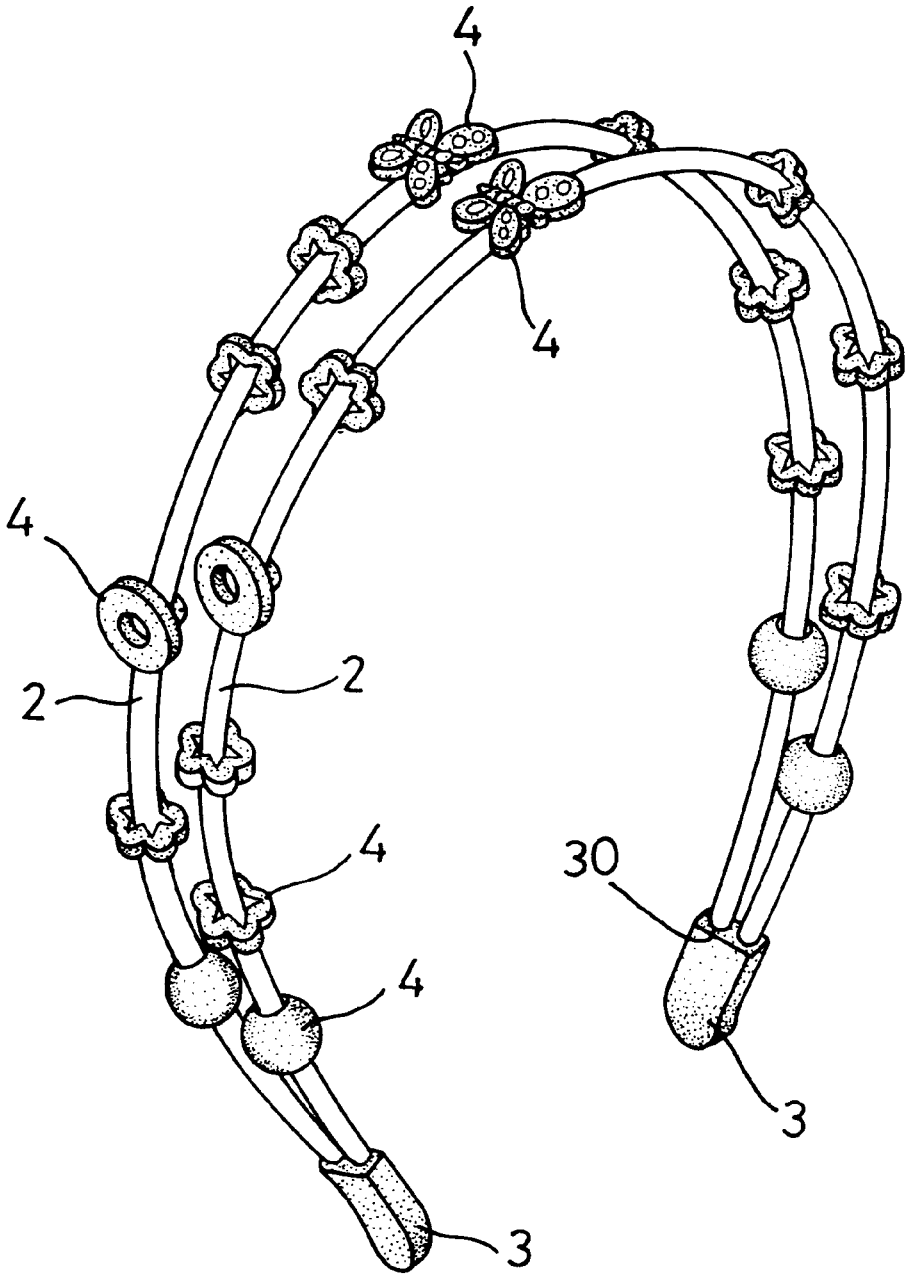
FIG. 3 is a perspective view of the barrette in the present invention.

In assembling, as shown in FIGS. 2 and 3, firstly, the trinkets 4 are fixed or hooked on the two elongate curved identical bodies 2, and then the two ends of the two elongate curved identical bodies 2 are inserted in the insert holes 30 of the position members 3, temporarily assembling the two elongate curved identical bodies 2 together by means of the two position members 3.

Figure 4:
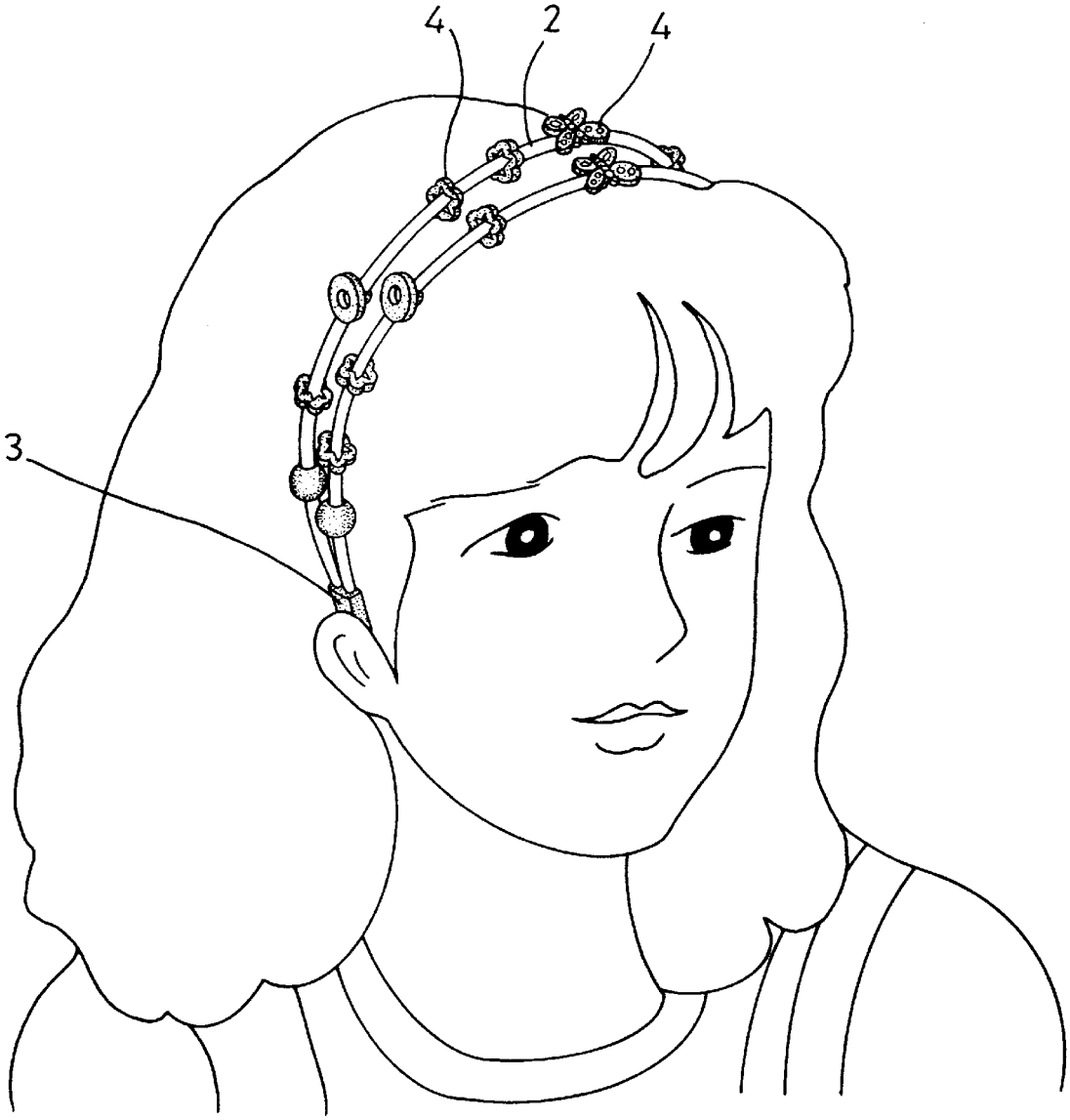
FIG. 4 is a perspective view of the barrette used on hairs in the present invention.

In using, as shown in FIG. 4, the barrette is placed on the hair of a user, slid from the front to the rear of the head. Then the constricting force of the two resilient elongate curved identical bodies 2 stabilizes the barrette on the hair with the help of the two position members 3 defining clamping points behind the two ears. In addition, the trinkets 4 function to decorate the hair and to produce friction against the hair, thus increasing the contacting surface of the barrette with the hair so as to prevent the barrette from sliding off or dishveeling hair.

The barrette in the invention has the following advantages.

1. The trinkets on the two elongate curved identical bodies can be easily altered according to users' tastes.
2. It can have two or more elongate curved identical bodies positioned in position members having the same number of holes as the ends of its elongate bodies.
3. The elongate curved identical bodies and the trinkets function to keep the barrette stabilized on and not to slide off the hair of a user, with the hair being kept neat.

While the preferred embodiment of the invention has been described above, it will be recognized and understood that various modifications may be made therein and the appended claims are intended to cover all such modifications which may fall within the spirit and scope of the invention.

What is claimed is:

1. A barrette comprising:

a pair of identical curved resilient elongate bodies for embracing the head and hair of a user, each elongate body having a pair of opposite ends;

a pair of position members, each position member having a pair of insert holes for receiving and tightly securing an end of each elongate body, the position members for defining clamping points behind the ears of a user wearing the barrette; and a plurality of trinkets secured to and spaced along each elongate body for increasing the contact surface and friction between the barrette and the hair of a user to maintain the barrette in place and preventing dishveeling of the hair.

2. The barrette of claim 1 wherein each trinket includes a decorative member and a fixing member for securing the decorative member to the elongate body.

3. The barrette of claim 2 wherein the fixing member is of a ring-shaped configuration.

4. The barrette of claim 2 wherein the fixing member is of a C-shaped configuration.

* * * * *